US009341071B2

(12) United States Patent
Healy et al.

(10) Patent No.: US 9,341,071 B2
(45) Date of Patent: May 17, 2016

(54) LOCKING SPACER ASSEMBLY

(71) Applicant: General Electric Company, Schenectady, NY (US)

(72) Inventors: Michael James Healy, Greenville, SC (US); Brian Denver Potter, Greer, SC (US)

(73) Assignee: General Electric Company, Schenectady, NY (US)

( * ) Notice: Subject to any disclaimer, the term of this patent is extended or adjusted under 35 U.S.C. 154(b) by 423 days.

(21) Appl. No.: 14/055,124

(22) Filed: Oct. 16, 2013

(65) Prior Publication Data

US 2015/0101351 A1 Apr. 16, 2015

(51) Int. Cl.
*F01D 5/30* (2006.01)
*F01D 5/32* (2006.01)

(52) U.S. Cl.
CPC . *F01D 5/303* (2013.01); *F01D 5/32* (2013.01)

(58) Field of Classification Search
CPC ..... F01D 5/302; F01D 5/32
See application file for complete search history.

(56) References Cited

U.S. PATENT DOCUMENTS 2,421,855 A * 6/1947 Soderberg ..... F01D 5/3038 416/217
3,088,708 A * 5/1963 Feinberg ..... F01D 5/3038 416/215
3,627,448 A 12/1971 Rupp et al.
3,955,898 A * 5/1976 Zaehring ..... F01D 5/32 416/215
4,208,170 A * 6/1980 Tucker ..... F01D 5/323 416/221
4,684,325 A 8/1987 Arnold
4,859,149 A 8/1989 McClain
H1258 H 12/1993 Hindle, Jr.
6,135,717 A 10/2000 Sokol et al.
6,638,006 B2 10/2003 Selby
6,647,602 B2 * 11/2003 Bachofner ..... F01D 5/3038 29/23.51
6,752,598 B2 * 6/2004 Antunes ..... F01D 5/32 416/215
6,929,453 B2 8/2005 Kite et al.
7,114,927 B2 10/2006 Bachofner
7,435,055 B2 10/2008 Hansen et al.
7,581,931 B2 * 9/2009 Shaefer et al. ..... F01D 5/06 277/416
8,176,598 B2 5/2012 Casavant et al.
8,757,981 B2 * 6/2014 Wiebe ..... F01D 5/3038 416/215
2001/0022936 A1 9/2001 Zimmermamm
2001/0055527 A1 * 12/2001 Yvon Goga ..... F01D 5/32 416/215
2004/0037703 A1 2/2004 Arinci et al.
2007/0280831 A1 12/2007 Pickens et al.
2009/0016889 A1 1/2009 Krutzfeldt et al.
2009/0220345 A1 * 9/2009 Krutzfeldt ..... F01D 5/3038 416/220 R
2011/0110782 A1 5/2011 Brittingham
2011/0164983 A1 7/2011 Garcia-Crespo et al.
2015/0101346 A1 4/2015 Foster et al.
2015/0101347 A1 4/2015 Potter et al.
2015/0101348 A1 4/2015 Hansen et al.
2015/0101349 A1 4/2015 Hansen et al.
2015/0101350 A1 4/2015 Healy et al.

* cited by examiner

*Primary Examiner* — Igor Kershteyn
(74) *Attorney, Agent, or Firm* — Dority & Manning, P.A.

(57) ABSTRACT

Locking spacer assemblies and turbomachines are provided. In one embodiment, a locking spacer assembly includes a spacer, the spacer including a platform and a plurality of legs extending generally radially inward from the platform. The locking spacer assembly further includes a clamp configured to contact and cause elastic deformation of each of the plurality of legs in a generally axial direction towards each other. The locking spacer assembly further includes a locking lug configured to contact and impart a force against each of the plurality of legs in an opposite generally axial direction.

20 Claims, 6 Drawing Sheets

LOCKING SPACER ASSEMBLY

FIELD OF THE INVENTION

The present invention generally involves a turbomachine. More specifically, the invention relates to locking spacer assemblies for securing rotor blades to a rotor disk of the turbomachine.

BACKGROUND OF THE INVENTION

Various turbomachines such as a gas turbine or steam turbine include a shaft, multiple rotor disks coupled to the shaft and various rotor blades mounted to the rotor disks. A conventional gas turbine includes a rotatable shaft with various rotor blades mounted to discs in the compressor and turbine sections thereof. Each rotor blade includes an airfoil over which pressurized air, combustion gases or other fluids such as steam flows, and a platform at the base of the airfoil that defines a radially inner boundary for the air or fluid flow.

The rotor blades are typically removable, and therefore include a suitable root portion such as a T-type root portion that is configured to engage a complementary attachment slot in the perimeter of the rotor disk. The root may either be an axial-entry root or a circumferential-entry root that engages with corresponding axial or circumferential slots formed in the disk perimeter. A typical root includes a neck of minimum cross sectional area and root protrusions that extend from the root into a pair of lateral recesses located within the attachment slot.

For circumferential roots, a single attachment slot is formed between forward and aft continuous circumferential posts or hoops that extend circumferentially around the entire perimeter of forward and aft faces of the rotor disk. The cross-sectional shape of the circumferential attachment slot includes lateral recesses defined by the forward and aft rotor disk posts or hoops that cooperate with the root protrusions of the rotor blades to radially retain the individual blades during turbine operation.

In the compressor section of a gas turbine, for example, rotor or compressor blades (specifically the root component) are inserted into and around the circumferential slot and rotated approximately ninety degrees to bring the root protrusions of the rotor blades into contact with the lateral recesses to define a complete stage of rotor blades around the circumference of the rotor disks. The rotor blades include platforms at the airfoil base that may be in abutting engagement around the slot. In other embodiments, spacers may be installed in the circumferential slot between adjacent rotor blade platforms. Once all of the blades (and spacers) have been installed, a final remaining space(s) in the attachment slot is typically filled with a specifically designed spacer assembly, as generally known in the art.

A common technique used to facilitate the insertion of the final spacer assembly into the circumferential slot is to include a non-axi symmetric loading slot in the rotor disc. Various conventional spacer assemblies have been designed to eliminate the need for a loading slot in the rotor disk. However, these assemblies include complex devices. These conventional assemblies are generally difficult to assemble, costly to manufacture and may result in unbalanced axial loading. Accordingly, there is a need for an improved locking spacer assembly that is relatively easy to assemble within the final space between platforms of adjacent rotor blades of a turbomachine such as compressor and/or turbine rotor blades of a gas turbine.

BRIEF DESCRIPTION OF THE INVENTION

Aspects and advantages of the invention are set forth below in the following description, or may be obvious from the description, or may be learned through practice of the invention.

In accordance with one embodiment of the present disclosure, a locking spacer assembly for insertion into a circumferential attachment slot between platforms of adjacent rotor blades is provided. The locking spacer assembly includes a spacer, the spacer including a platform and a plurality of legs extending generally radially inward from the platform. The locking spacer assembly further includes a clamp configured to contact and cause elastic deformation of each of the plurality of legs in a generally axial direction towards each other. The locking spacer assembly further includes a locking lug configured to contact and impart a force against each of the plurality of legs in an opposite generally axial direction.

In accordance with another embodiment of the present disclosure, a locking spacer assembly for insertion into a circumferential attachment slot between platforms of adjacent rotor blades is provided. The locking spacer assembly includes a spacer, the spacer including a platform and a plurality of legs extending generally radially inward from the platform. The locking spacer assembly further includes means for elastically deforming each of the plurality of legs in a generally axial direction towards each other. The locking spacer assembly further includes a locking lug configured to contact and impart a force against each of the plurality of legs in an opposite generally axial direction.

In accordance with another embodiment of the present disclosure, a turbomachine is provided. The turbomachine includes a compressor section, a turbine section, and a combustor section between the compressor section and the turbine section. One of the compressor section or the turbine section includes a rotor disc comprising forward and aft posts defining a continuous circumferentially extending attachment slot, and a plurality of rotor blades, each of the plurality of rotor blades extending from one of a plurality of platforms, wherein each of the plurality of platforms is secured to the attachment slot by an inwardly extending root. One of the compressor section or the turbine section further includes a locking spacer assembly disposed in a space between at least two of the plurality of platforms. The locking spacer assembly includes a spacer, the spacer including a platform and a plurality of legs extending generally radially inward from the platform. The locking spacer assembly further includes a clamp configured to contact and cause elastic deformation of each of the plurality of legs in a generally axial direction towards each other. The locking spacer assembly further includes a locking lug configured to contact and impart a force against each of the plurality of legs in an opposite generally axial direction.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
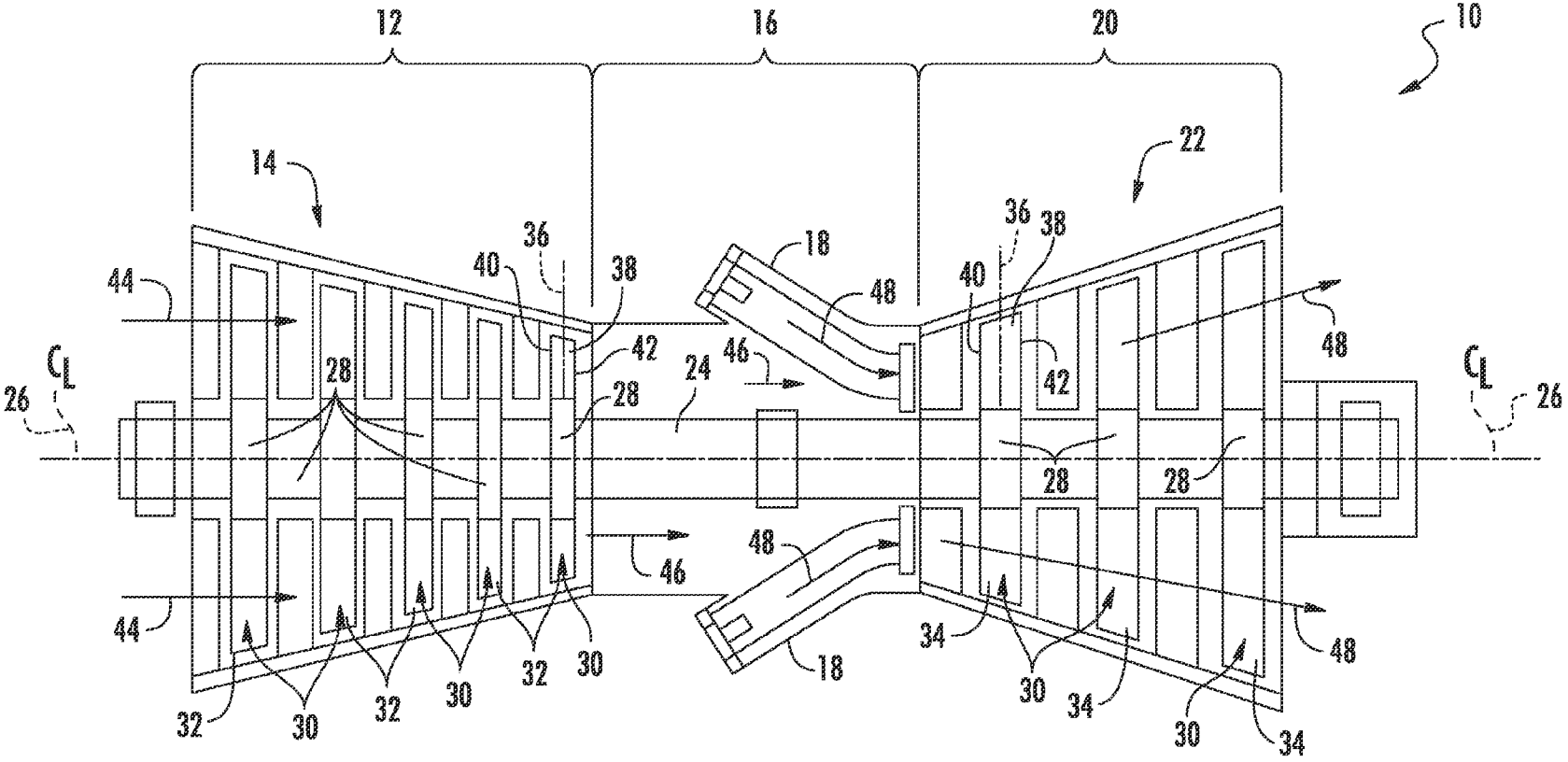
FIG. 1 (PRIOR ART)
FIG. 1 is a functional diagram of an exemplary gas turbine within the scope of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows. The term "radially" refers to the relative direction that is substantially perpendicular to an axial centerline of a particular component, and the term "axially" refers to the relative direction that is substantially parallel to an axial centerline of a particular component.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Although exemplary embodiments of the present invention will be described generally in the context of a gas turbine for purposes of illustration, one of ordinary skill in the art will readily appreciate that embodiments of the present invention may be applied to any turbomachine having a shaft and rotating blades coupled to the shaft such as a steam turbine or the like, and are not limited to a gas turbine unless specifically recited in the claims.

Referring now to the drawings, wherein identical numerals indicate the same elements throughout the figures, FIG. 1 provides a functional diagram of one embodiment of a turbomachine, in this case an exemplary gas turbine 10 that, may incorporate various embodiments of the present invention. It should be understood that the present disclosure is not limited to gas turbines, and rather that steam turbines or any other suitable turbomachines are within the scope and spirit of the present disclosure. As shown, the gas turbine 10 generally includes a compressor section 12 including a compressor 14 disposed at an upstream end of the gas turbine 10, a combustion section 16 having at least one combustor 18 downstream from the compressor 14, and a turbine section 20 including a turbine 22 that is downstream from the combustion section 16. A shaft 24 extends along an axial centerline 26 of the gas turbine 10 at least partially through the compressor 14 and/or the turbine 22. In particular configurations, the shaft 24 may comprise of a plurality of individual shafts.

Multiple rotor wheels or disks 28 are disposed coaxially along the shaft 24 within the compressor 14 and/or the turbine 22. Each rotor disk 28 is configured to receive a plurality of radially extending rotor blades 30 that are circumferentially spaced around and removably fixed to the rotor disk 28. The rotor blades 30 may be configured for use within the compressor 14 such as a compressor rotor blade 32 or for use within the turbine 22 such as a turbine bucket or turbine rotor blade 34. Each blade 30 has a longitudinal centerline axis 36 and includes an airfoil portion 38 having a leading edge 40 and a trailing edge 42.

In operation, a working fluid 44 such as air is routed into the compressor 14 where it is progressively compressed in part by the compressor rotor blades 32 as it is routed towards the combustion section 16. A compressed working fluid 46 flows from the compressor 14 and is supplied to the combustion section 16. The compressed working fluid 46 is distributed to each of the combustors 18 where it is mixed with a fuel to provide a combustible mixture. The combustible mixture is burned to produce combustion gases 48 at a relatively high temperature and high velocity. The combustion gases 48 are routed through the turbine 22 where thermal and kinetic energy is transferred to the turbine rotor blades 34, thereby causing the shaft 24 to rotate. In particular applications, the shaft 24 is coupled to a generator (not shown) to produce electricity.

Figure 2:
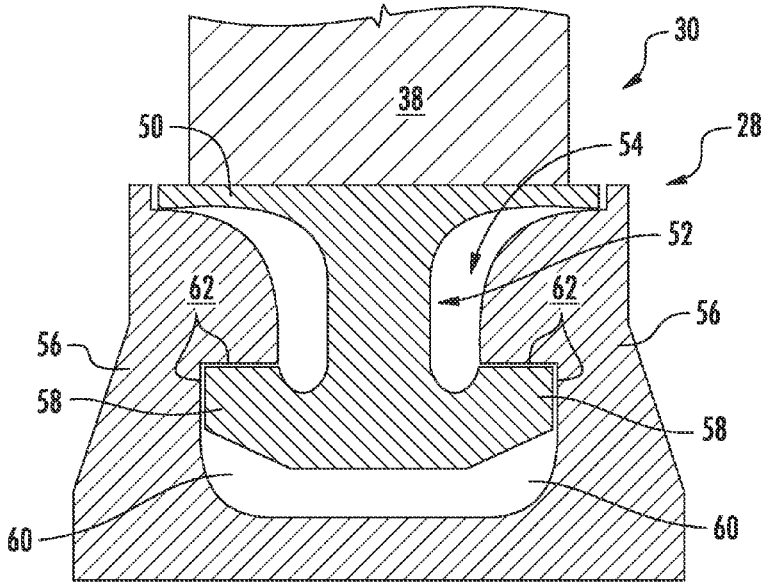
FIG. 2 is a partial sectional view of an embodiment of a root and attachment slot configuration for circumferential entry rotor blades.

FIG. 2 is an enlarged cross section view of a portion of an exemplary rotor disk 28 including an exemplary rotor blade 30 having a T-type root and attachment slot configuration. As shown in FIG. 2, each rotor blade 30 also may include a platform 50 that provides a portion of a radially inner boundary for airflow, combustion gas flow or other fluid flow such as steam over the airfoils 38 during operation of the gas turbine 10. In addition, each rotor blade 30 includes an integral root portion 52 that extends radially inward from the platform 50. The root portion 52 slides into and along a circumferentially extending attachment slot 54 defined by forward and aft post or hoop components 56 of the rotor disk 28, as is generally known in the art.

The root portion 52 may include protrusions 58 that are received into lateral recesses 60 defined within the attachment slot 54 and at least partially defined by recessed wall portions 62 of the hoop components 56. It should be readily appreciated that the configuration of the root portion 52 and attachment slot 54 provided in FIG. 2 is for illustrative purposes only, and that the root and slot configuration may vary widely within the scope and spirit of the present subject matter.

Figure 3:
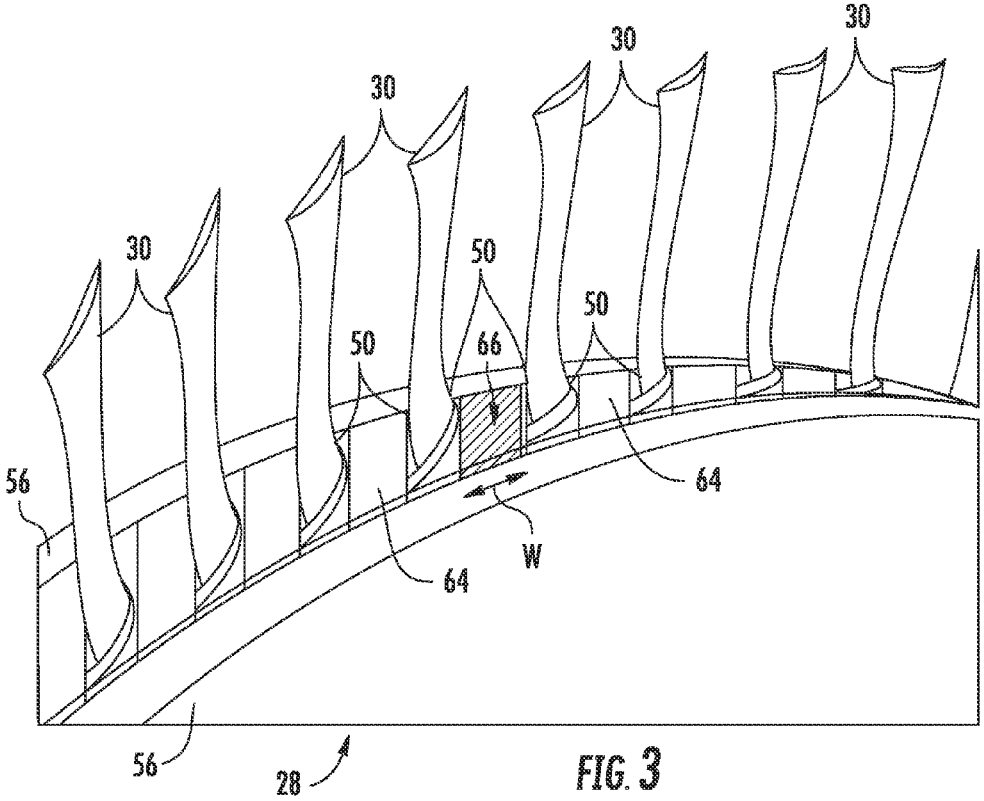
FIG. 3 is a partial perspective view of an exemplary rotor disk including final or load-in spaces into which a locking spacer assembly may be inserted.
Figure 4:
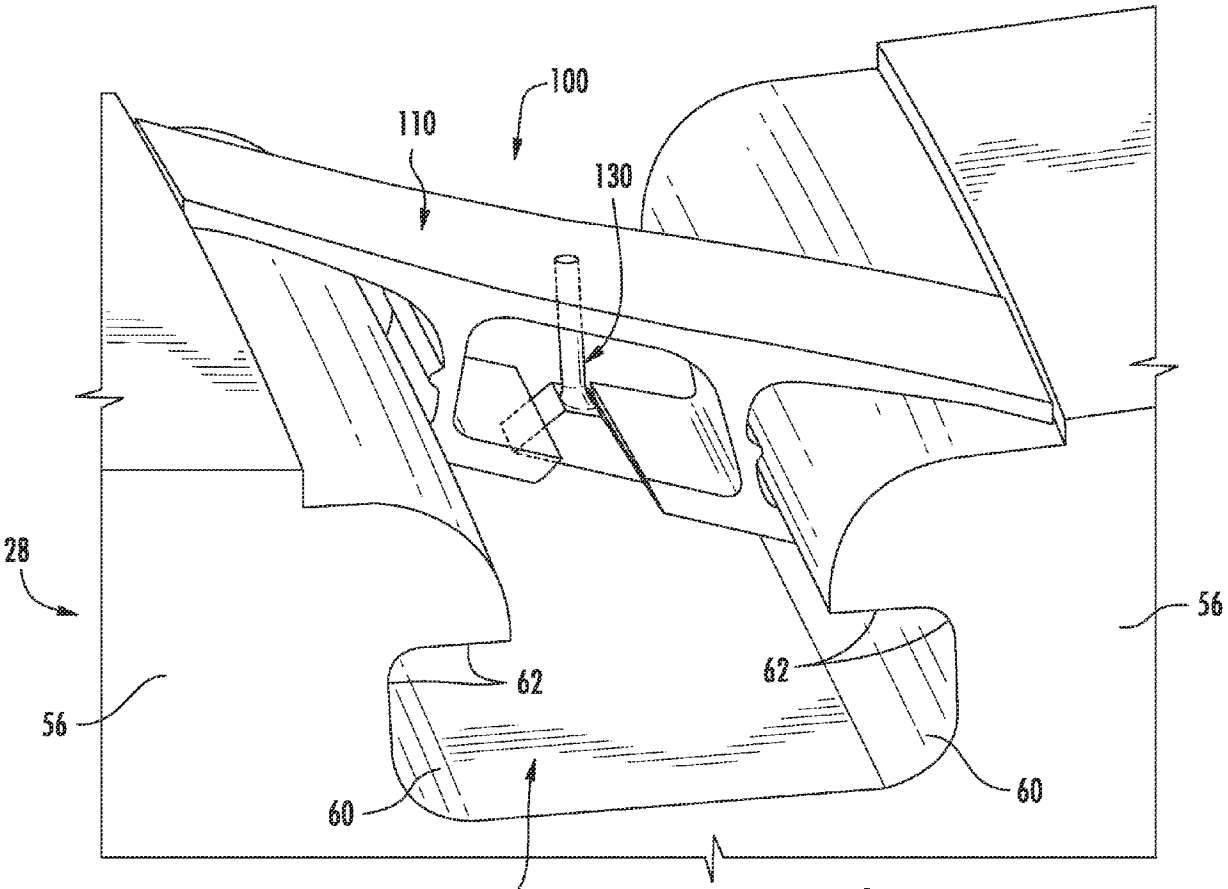
FIG. 4 is an perspective view of a locking spacer assembly in an attachment slot in accordance with aspects of the present subject matter.

FIG. 3 is a partial perspective view of a portion of an exemplary rotor disk 28, and particularly illustrates a plurality of the rotor blades 30 configured in an attachment slot 54 (FIG. 2) between the forward and aft hoop components 56 of the rotor disk 28. As shown, each of the rotor blades 30 includes a platform 50. As shown in FIG. 3, conventional spacers 64 are disposed between the platforms 50 of adjacent rotor blades 30, as is generally known in the art.

Final or load-in spaces 66, having a circumferential width W between adjacent rotor blade 30 platforms 50, can be filled by various embodiments of a locking spacer assembly 100 as shown in FIGS. 4-11, which is described in greater detail below. The final or load-in spaces 66 are generally used to insert the rotor blades 30 into the attachment slot 54 during assembly and/or disassembly of the rotor blades 30 to the rotor disk 28. It should be appreciated that in particular embodiments, the locking spacer assembly 100 can be used to fill final spaces 66 between platforms 50 of adjacent rotor blades 30 including the compressor rotor blades 32 located within the compressor 14 and/or the turbine rotor blades 34 located within the turbine 22. As such, the locking spacer assembly 100 will be generally described below as being installed between platforms 50 of adjacent rotor blades 30, wherein the platforms 50 and rotor blades 30 may be part of a compressor rotor blade 32 or a turbine rotor blade 34 so as to fully encompass both applications.

Referring to FIGS. 4 through 7, embodiments of a locking spacer assembly 100 according to the present disclosure are illustrated. The assembly 100 includes a spacer 110. The spacer 110 generally is configured to fit into a final space 66 between platforms 50 of adjacent rotor blades 30. For example, spacer 110 may include a platform 112. The platform 112 thus may have any dimensional configuration such that the width, length, thickness, or any other characteristics enables the platform 112 to be inserted between the platforms 50. For example, the platform 112 may generally have a horizontal width W (FIG. 3) in order to fit snugly between the platforms 50 of adjacent rotor blades 30.

Spacer 110 may further include a plurality of legs 114 extending generally radially inward (when the spacer 110 is in an assembled position) from the platform 112. In exemplary embodiments, two legs 114 may extend from the platform 112, and may generally face each other. The legs 114 may, for example, be spaced apart in the generally axial direction.

To fit the spacer 110 into the attachment slot 54, legs 114 may be elastically deformable. Each leg 114, and the spacer 110 in general, may thus be formed from a suitable elastically deformable material, such as in some embodiments aluminum or another suitable metal. Means for elastically deforming each of the plurality of legs 114 in a generally axial direction towards each other may be utilized to facilitate such leg deformation, such that the legs are deformed inward and allow the spacer 110 to fit into the attachment slot 54.

Figure 5:
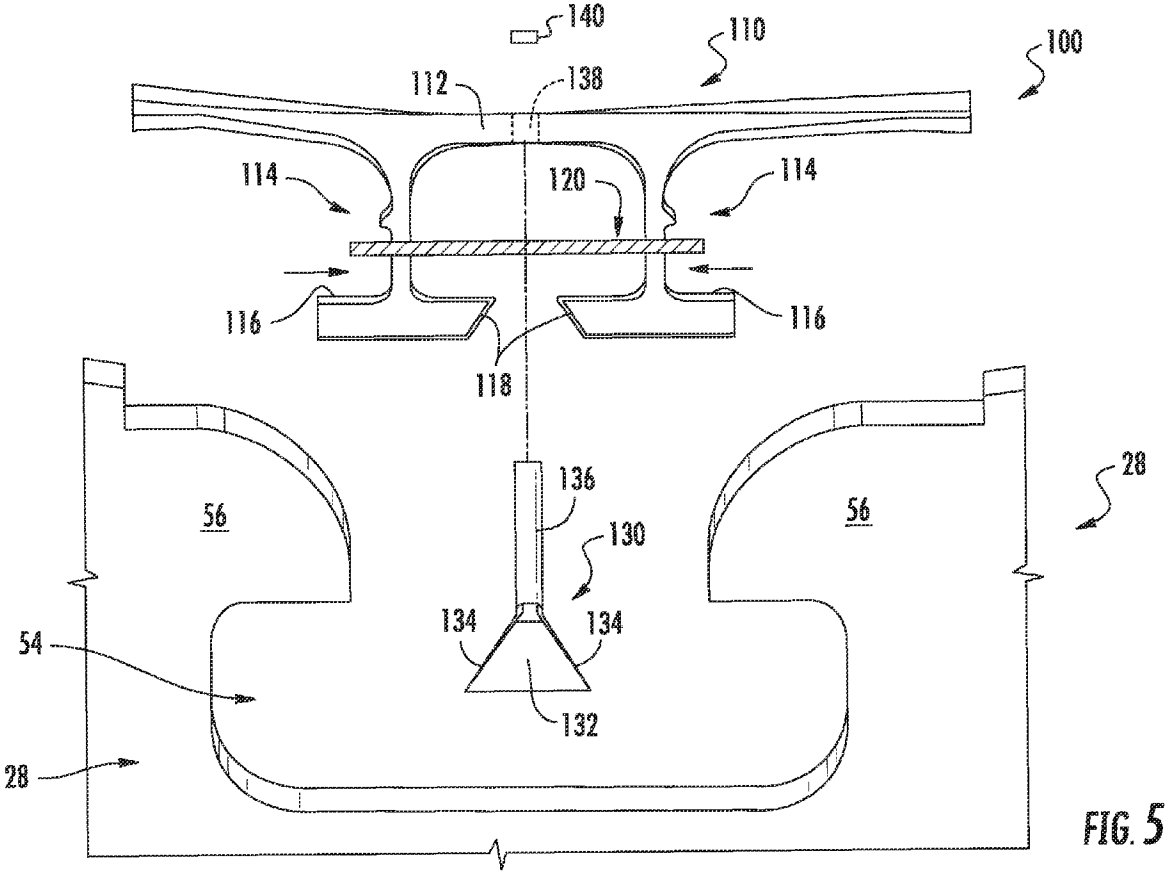
FIG. 5, FIG. 6, and FIG. 7 are sequential assembly views of an embodiment of a locking spacer assembly in accordance with aspects of the present subject matter.

In some exemplary embodiments, the means for elastically deforming may be a clamp 120. Clamp 120 may generally be any suitable clamping apparatus capable of providing an axially inward force onto the legs 114 such that the legs 114 elastically deform generally axially inward towards each other. FIG. 5 illustrates legs 114 in the inwardly deformed position. In some embodiments, for example, clamp 120 may be a C-clamp, a brace, a strap, a zip-tie, a rope, or a screw apparatus. The clamp 120 may, as shown, be placed in contact with each leg 114, and then actuated to provide a generally axially inward force on the legs 114, until the legs 114 elastically deform generally axially inwards towards each other. Such deformation towards each other may be sufficient such that the legs 115 can fit within and past the narrowest portion of the slot 54, thus clearing hoop component 56 protrusions that define the narrowest portion of the slot 54.

Figure 6:
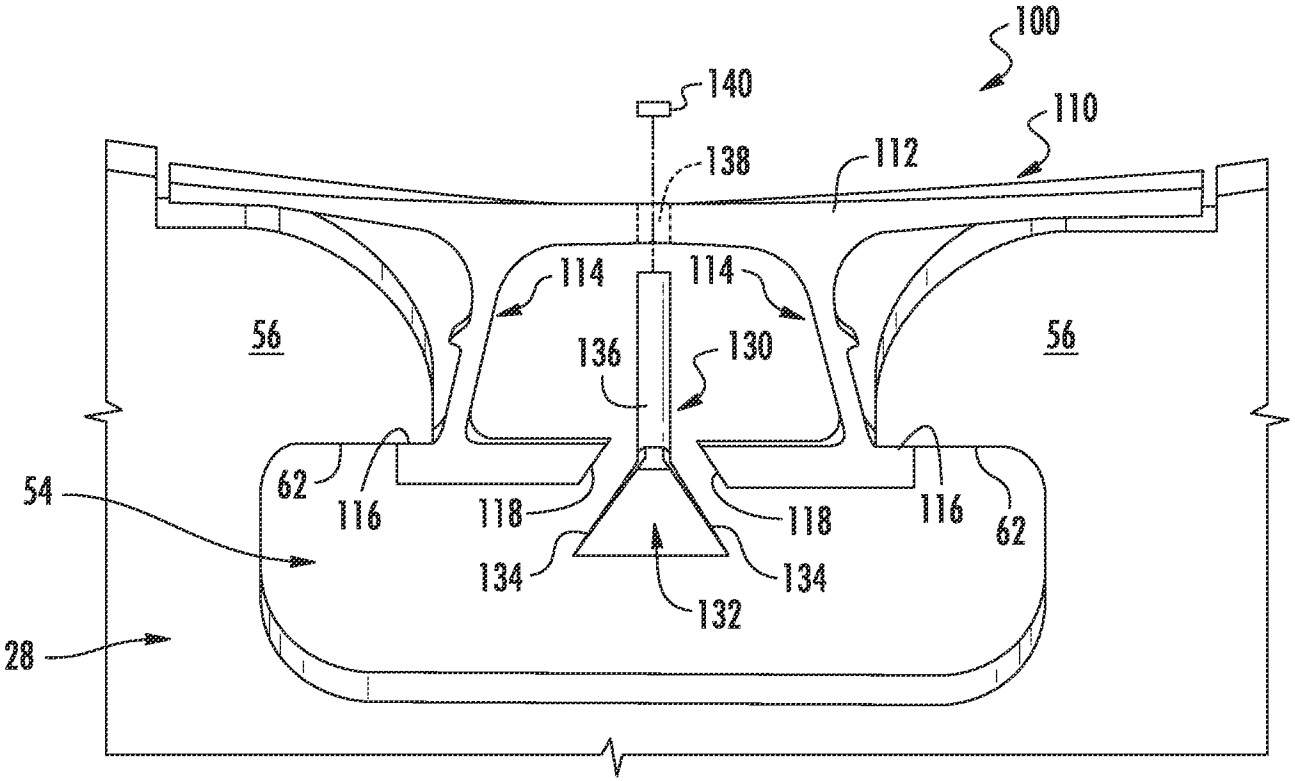

In exemplary embodiments, the clamp 120 may be removable from the plurality of legs 114. For example, after the spacer 110 is fit into the attachment slot 54, the clamp 120 may be disengaged from the legs 114, and may further be disconnected from the legs 114. Such disengagement may allow the legs 114 to return to their original, non-elastically deformed axial positions, as shown in FIG. 6. Once disconnected from the legs 114, the clamp 120 may be removed from the attachment slot 54.

In other embodiments, the means for elastically deforming may include physical force imparted by, for example, a person to the legs 114 to cause the legs to elastically deform generally axially inwards. In still other embodiments, the spacer 110 could be forced down radially onto the disk 28 by, for example, a human or machine-based force until an axial component of the force causes the legs 114 to deform generally axially inwards.

Legs 114 may further, in exemplary embodiments, include contact surface 116. Each contact surface 116 may be configured to contact a recessed wall portion 62 of the attachment slot 54. As illustrated in, for example, FIGS. 6 and 7, after the spacer 110 is fit within the attachment slot 54, the contact surfaces 116 may be brought into contact with the recessed wall portions 62. Such contact may position the spacer 110 within the attachment slot 54. The recessed wall portions 62 and contact surfaces 116 may have any suitable sizes, orientations, etc. The contact surfaces 116 may in some embodiments have generally identical orientations, such that they mate with the recessed wall portions 62 when brought into contact therewith.

Figure 7:
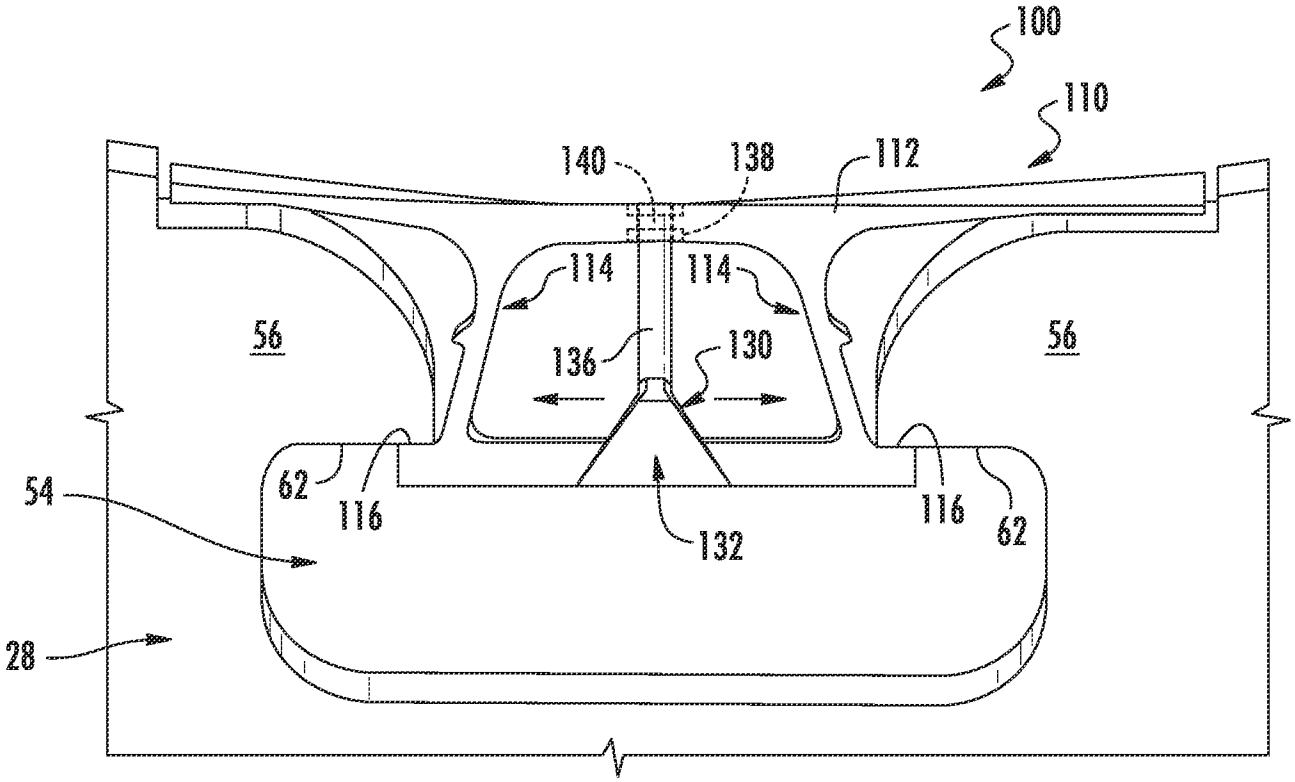

Locking spacer assembly 100 may further, in exemplary embodiments, include a locking lug 130. As shown in FIG. 7, the locking lug 130 may be configured to contact and impart a force against each of the plurality of legs 114 in an opposite generally axial direction, such as a generally axial direction opposite to the generally axial direction of elastic deformation by the means for elastically deforming. Such opposite generally axial force may, in some embodiments, elastically deform the legs 114 in the generally opposite axial direction. Additionally or alternatively, the generally opposite axial force may, for example, be transmitted through the legs 114 to the disk 28. By providing such force, the locking lug 130 may lock the locking spacer assembly 100 within the attachment slot 54, thus generally reducing or preventing axial and radial movement of the locking spacer assembly 100.

For example, as illustrated, each leg 114 may include a wedge surface 118. The wedge surface 118 may be generally angled with respect to the radial and axial directions, as shown. In embodiments wherein two facing legs 114 are utilized, the wedge surfaces 118 may for example face each other and be angled such that they approach each other axially along the generally radially outward direction. Further, locking lug 130 may include a wedge 132. Wedge 132 may have various mating wedge surfaces 134, such as two opposing mating wedge surface 134 as illustrated. Each mating wedge surface 134 may contact a wedge surface 118. In exemplary embodiments, each mating wedge surface 134 may have a generally identical angle to the wedge surface 118 which it contacts. For example, the mating wedge surfaces 134 may be generally angled with respect to the radial and axial directions, as shown. Further, as shown, the mating wedge surfaces 134 may taper in the generally radially outward direction.

Locking lug 130 may further include, for example, a rod 136. Rod 136 may extend generally radially outwardly (when in the assembled position) from the wedge 132. Rod 136 may further be extendable through a bore hole 138 defined in the spacer 110, such as in the platform 112 thereof. For example, bore hole 138 may be defined generally centrally in the platform 112, such as between the legs 114, and may extend generally radially through the platform 112. When assembled, the rod 136 may extend through at least a portion of the bore hole 138.

Further, in some embodiments, locking spacer assembly 100 may include a fastener 140. Fastener 140 may be connectable to the rod 136 to fasten the locking lug 130 and spacer 110 together, thus locking the locking spacer assembly 100 in position. Fastener 140 may generally comprise any locking mechanism that may be used to fasten the locking lug 130 and spacer 110 together. As shown, for example, the fastener 140 may have a threaded female end which can be screwed onto a threaded male end of the rod 136. In exemplary embodiments, fastener 140 when connected to the rod 136 may be disposed in the bore hole 138.

Thus, in exemplary embodiments, locking lug 130 may be positioned within the attachment slot 54 before the spacer 110, as shown in FIG. 5. As further, shown, means for elastically deforming may elastically deform the legs 114 towards each other. The spacer 110 may then be fit within the attachment slot 54, and the means released, such that for example the legs 114 return to non-elastically deformed positions, as shown in FIG. 6. The locking lug 130 may then be brought into contact with the legs 114, and such contact may provide a force in a generally opposite axial direction to the legs 114, which may for example press contact surfaces 116 of the legs 114 against recessed portions 62 of the attachment slot 54. The locking lug 130 may finally be fastened to the spacer 110, thus locking the locking spacer assembly 100 in place in the slot 54.

It should be appreciated that the present subject matter also encompasses a rotor assembly incorporating a locking spacer assembly 100 as described and embodied herein. The rotor assembly includes a rotor disc 28 with forward and aft posts 56 defining a continuous circumferentially extending attachment slot 54. The rotor assembly also includes a plurality of rotor blades 30, with each rotor blade 30 extending from a platform 50. The platform 50 is secured within the attachment slot 54 by an inwardly extending root 52. At least one locking spacer assembly 100 in accordance with any of the embodiments illustrated or described herein is disposed in a space 66 between two of the platforms 50. It should be readily appreciated, as indicated above, that the rotor assembly may be disposed in the compressor or turbine section of a gas turbine, with the platforms 50 and rotor blades 30 being part of a complete stage of either rotor blades or turbine buckets.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A locking spacer assembly for insertion into a circumferential attachment slot between platforms of adjacent rotor blades, comprising:

a spacer, the spacer comprising a platform and a plurality of legs extending generally radially inward from the platform;

a clamp configured to contact and cause elastic deformation of each of the plurality of legs in a generally axial direction towards each other; and a locking lug configured to contact and impart a force against each of the plurality of legs in an opposite generally axial direction.

2. The locking spacer assembly of claim 1, wherein each of the plurality of legs comprises a wedge surface and the locking lug comprises wedge having a plurality of mating wedge surfaces, and wherein contact between the wedge surfaces and mating wedge surfaces causes elastic deformation of each of the plurality of legs in the opposite generally axial direction.

3. The locking spacer assembly of claim 2, wherein the mating wedge surfaces taper in a generally radially outward direction.

4. The locking spacer assembly of claim 1, wherein the locking lug comprises a rod.

5. The locking spacer assembly of claim 4, wherein the rod is extendable through a bore hole defined in the platform.

6. The locking spacer assembly of claim 4, further comprising a fastener connectable to the rod.

7. The locking spacer assembly of claim 1, wherein each of the plurality of legs comprises a contact surface configured to contact a recessed wall portion of the slot.

8. The locking spacer assembly of claim 1, wherein the clamp is removable from the plurality of legs.

9. A locking spacer assembly for insertion into a circumferential attachment slot between platforms of adjacent rotor blades, comprising:

a spacer, the spacer comprising a platform and a plurality of legs extending generally radially inward from the platform;

means for elastically deforming each of the plurality of legs in a generally axial direction towards each other; and a locking lug configured to contact and impart a force against each of the plurality of legs in an opposite generally axial direction.

10. The locking spacer assembly of claim 9, wherein each of the plurality of legs comprises a wedge surface and the locking lug comprises wedge having a plurality of mating wedge surfaces, and wherein contact between the wedge surfaces and mating wedge surfaces causes elastic deformation of each of the plurality of legs in the opposite generally axial direction.

11. The locking spacer assembly of claim 10, wherein the mating wedge surfaces taper in a generally radially outward direction.

12. The locking spacer assembly of claim 9, wherein the locking lug comprises a rod.

13. The locking spacer assembly of claim 12, wherein the rod is extendable through a bore hole defined in the platform.

14. The locking spacer assembly of claim 12, further comprising a fastener connectable to the rod.

15. The locking spacer assembly of claim 9, wherein each of the plurality of legs comprises a contact surface configured to contact a recessed wall portion of the slot.

16. A turbomachine, comprising:

a compressor section;

a turbine section; and a combustor section between the compressor section and the turbine section, wherein one of the compressor section or the turbine section comprises:

a rotor disc comprising forward and aft posts defining a continuous circumferentially extending attachment slot;

a plurality of rotor blades, each of the plurality of rotor blades extending from one of a plurality of platforms, wherein each of the plurality of platforms is secured to the attachment slot by an inwardly extending root; and a locking spacer assembly disposed in a space between at least two of the plurality of platforms, the locking spacer assembly comprising:

a spacer, the spacer comprising a platform and a plurality of legs extending generally radially inward from the platform;

a clamp configured to contact and cause elastic deformation of each of the plurality of legs in a generally axial direction towards each other; and a locking lug configured to contact and impart a force against each of the plurality of legs in an opposite generally axial direction.

17. The turbomachine of claim 16, wherein each of the plurality of legs comprises a wedge surface and the locking lug comprises wedge having a plurality of mating wedge surfaces, and wherein contact between the wedge surfaces and mating wedge surfaces causes elastic deformation of each of the plurality of legs in the opposite generally axial direction.

18. The turbomachine of claim 17, wherein the mating wedge surfaces taper in a generally radially outward direction.

19. The turbomachine of claim 16, wherein the locking lug comprises a rod.

20. The turbomachine of claim 16, wherein the clamp is removable from the plurality of legs.

* * * * *